US006066007A

United States Patent [19]

Huang

[11] Patent Number: 6,066,007

[45] Date of Patent: May 23, 2000

[54] TERMINAL THAT CAN BE POSITIVELY SECURED IN POSITION AND PERMITS GOOD ELECTRIC CONDUCTION

[75] Inventor: Alex Huang, Taipei, Taiwan

[73] Assignee: Cvilux Corporation, Taipei Hsien, Taiwan

[21] Appl. No.: 09/323,003

[22] Filed: Jun. 1, 1999

[51] Int. Cl.[7] ..... H01R 13/432

[52] U.S. Cl. ..... 439/748; 439/872

[58] Field of Search ..... 439/748, 746, 439/747, 749, 872, 852, 851

[56] References Cited

U.S. PATENT DOCUMENTS 5,489,223 2/1996 Faje et al. ..... 439/748
5,823,833 10/1998 Castaldo ..... 439/851
5,911,603 1/1999 Mansutti ..... 439/748

*Primary Examiner*—Lincoln Donovan
*Assistant Examiner*—Hae Moon Hyeon
*Attorney, Agent, or Firm*—A & J

[57] ABSTRACT

An improved terminal includes a through slot adapted for passage of an electrical wire. The terminal has one end provided with a clamp plate and a fastening plate adapted to secure a sheath and core wire of the electrical wire. The terminal is provided with through holes on two opposed side walls thereof at an intermediate section. Each of the through holes has an elastic curved urging plate extending from a side that is proximate to a front end of the terminal. The terminal further has a slot formed in a bottom side near the front end. An abutting plate extends into the slot. Two opposed depressed curved faces are formed on both side walls of the slot.

1 Claim, 7 Drawing Sheets

TERMINAL THAT CAN BE POSITIVELY SECURED IN POSITION AND PERMITS GOOD ELECTRIC CONDUCTION

BACKGROUND OF THE INVENTION (a) Field of the Invention

The present invention relates to an improved terminal that can be positively secured in position and permits good electric conduction.

(b) Description of the Prior Art

The electronics industry is a major industry of the new era and develops very fast, in particular the computer industry. There are numerous kinds of computer peripherals and accessories available on the market. For terminals, although they are very small, if their structure is not properly designed, it will cause inconvenience in use.

FIG. 1 shows the structure of a conventional terminal 10. The terminal 10 mainly has a slot 11 at one end for receiving a wire, a clamp plate 12 at the opposite end adapted for clamping the sheath of the wire, a fastening plate 13 adapted for clamping a core wire 30 inside the wire, a notch 14 in a bottom side proximate to the slot 11, and a stop plate 15 extending from one side into the notch 14. In addition, the notch 14 has two depressed contact points 16 on both sides thereof. Both sides of an intermediate section of the terminal 10 are provided with through holes 17 and retaining portions 18. The retaining portions 18 are bent with opposed outer sides forming a depression. The wire is disposed in the slot 11 of the terminal 10, and its sheath and core wire 30 are respectively secured in position by means of the clamp plate 12 and fastening plate 13. The contact points 16 at the front end of the terminal 10 are pressed inwardly so that the core wire 30 may contact the contact points 16 and the stop plate 15 to achieve electrical connection.

However, as the retaining portions 18 extending from the inner sides of the respective through holes 17 at the intermediate section of the terminal 10 have pointed rear ends, as shown in FIG. 2, when the terminal 10 is inserted into a terminal interface slot, it is difficult to push it in and requires a relatively large force to achieve engagement. Once the terminal 10 is inserted into the terminal interface slot, since the rear ends of the retaining portions 18 are pointed, the retaining effect is not good. Besides, the depressions on one side of the retaining portions 18, meant to enhance the structural strength thereof, are not easy to make during manufacture. Furthermore, since the stop plate 15 near the front end of the terminal 10 is pressed inwardly from the outer side of the front end of the terminal 10 to cause the contact points 16 and the stop plate 15 contact the core wire 30 respectively when the wire is inserted into the slot 11, as shown in FIG. 3, contact among the stop plate 15, the contact points 16, and the core wire 30, being in point contact with one another, may be defective through repeated engagement or disengagement of the terminals 10 in use. As a result, the terminal 10 becomes unusable.

Therefore, it is an object of the present invention to provide an improved terminal which can obviate and mitigate the above-mentioned drawbacks.

SUMMARY OF THE INVENTION

The present invention relates to an improved terminal that can be positively secured in position and permits good electric conduction.

Accordingly, a primary object of the present invention is to provide an improved terminal that has through holes and curved urging plates on both sides thereof. Each urging plate has a rear end forming an abutting plane. A slot is formed in a bottom side of the terminal near a front end thereof. An abutting plate having a depression extends from a front edge of the slot. Curved faces are provided on both sides of the slot. By means of the curved urging plates and the abutting planes thereof, the terminal can positively engage the interface slot and can be prevented from slippage. Furthermore, the curved faces on both sides of the abutting plate enable the terminal to couple with the electrical wire tightly to ensure good electrical connection.

The foregoing objects and summary provide only a brief introduction to the present invention. To fully appreciate these and other objects of the present invention as w ell as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
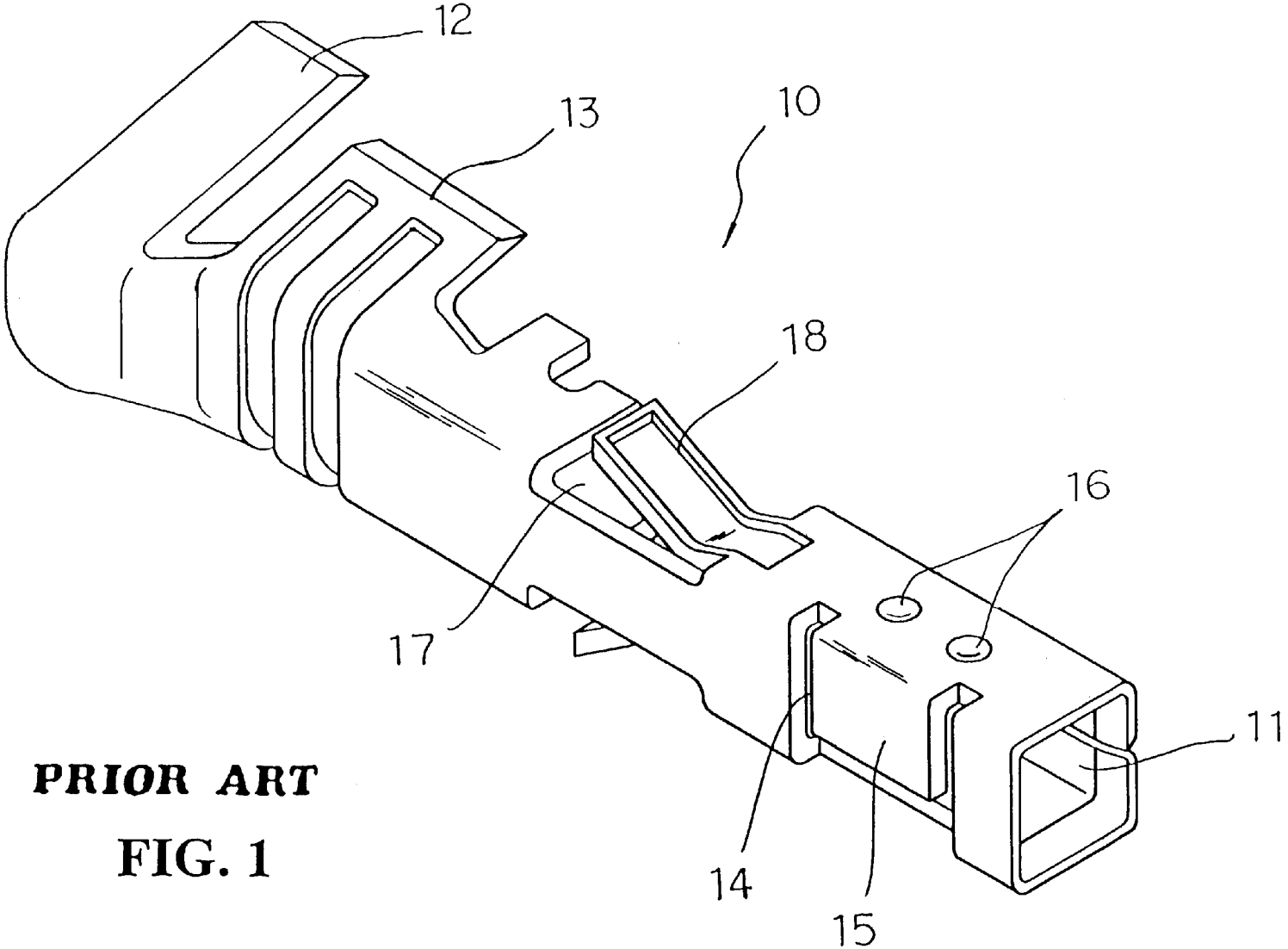
PRIOR ART FIG. 1
FIG. 1 is a schematic perspective view of a conventional terminal.
Figure 2:
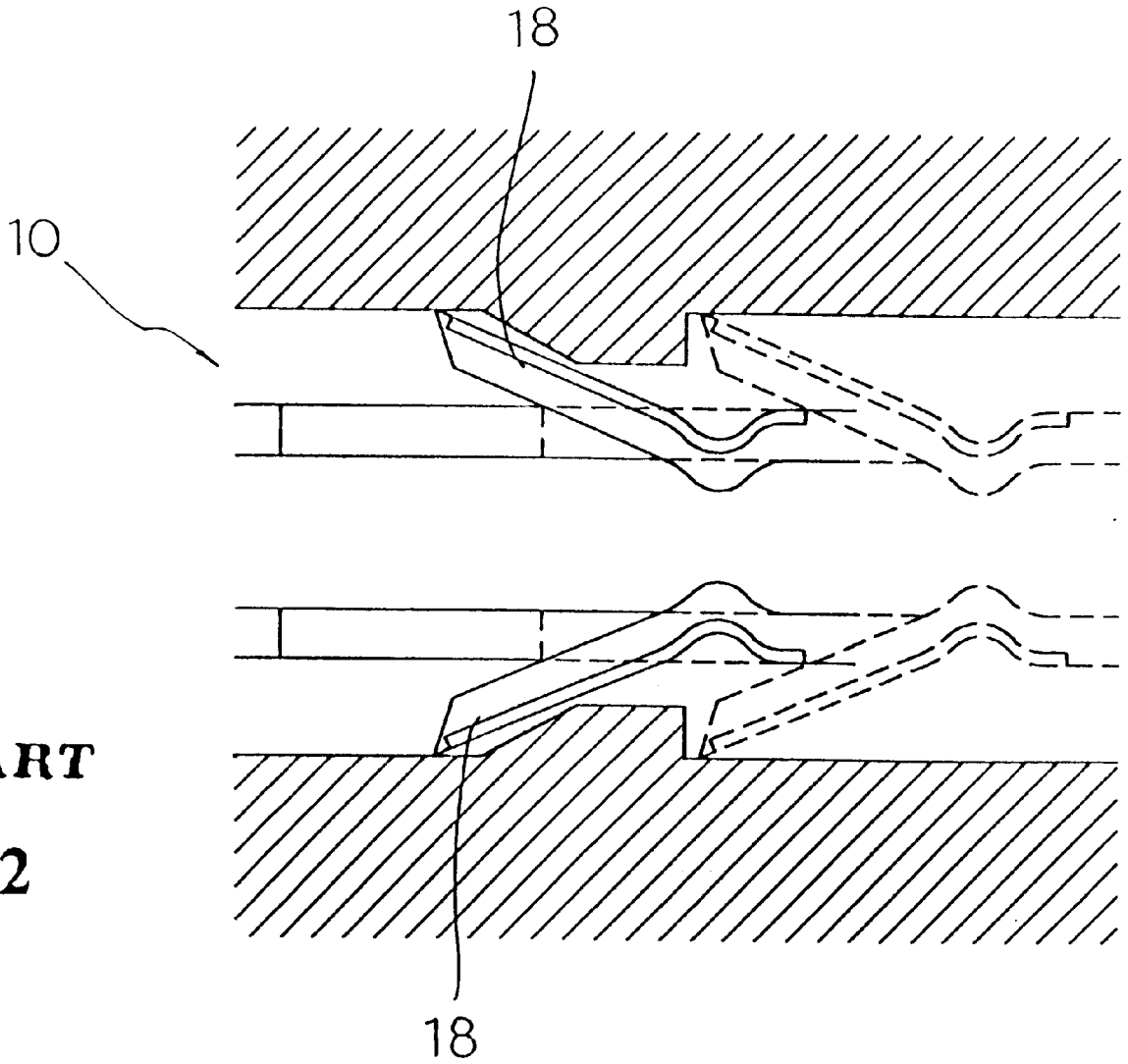
PRIOR ART FIG. 2
FIG. 2 is a schematic view in part illustrating engagement of the conventional terminal with an interface slot.
Figure 3:
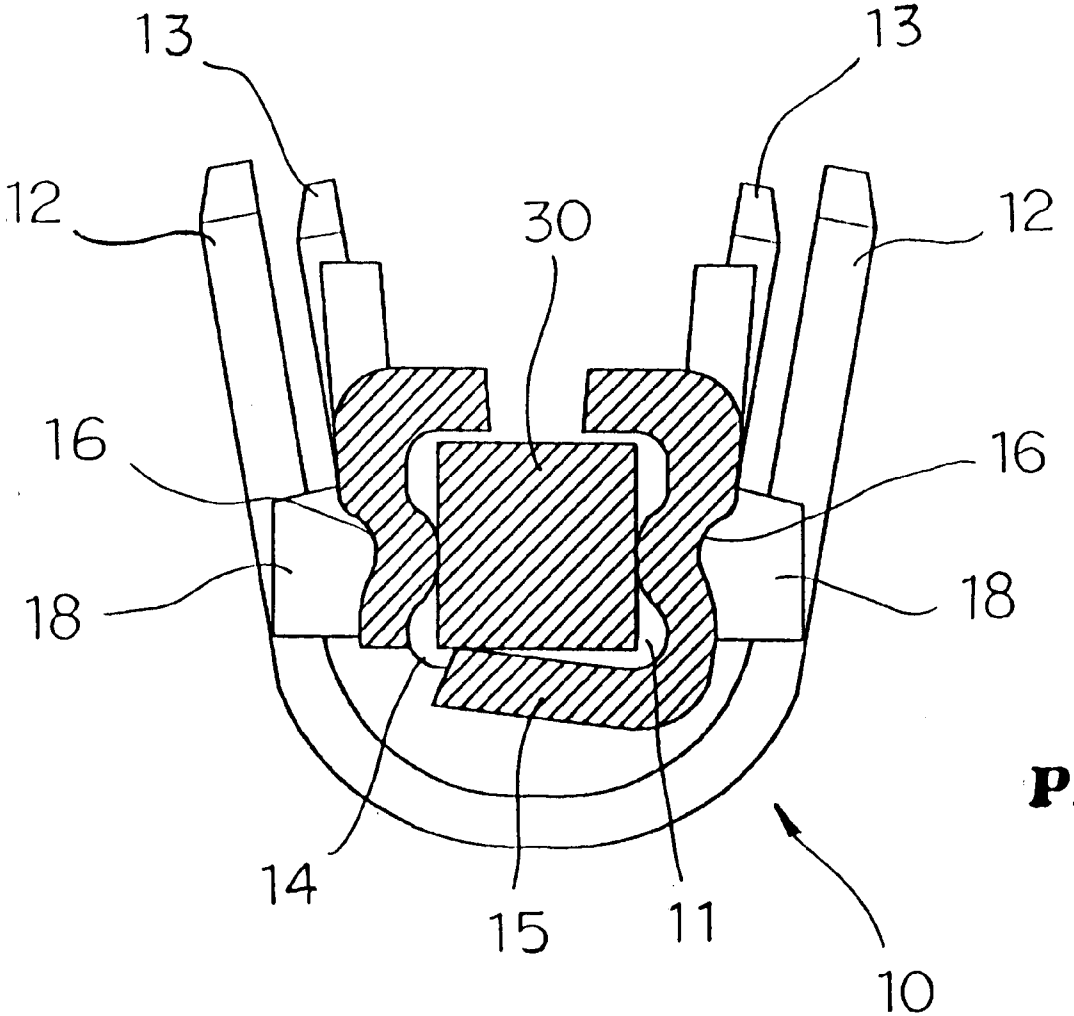
PRIOR ART FIG. 3
FIG. 3 is a schematic cross-sectional view of the conventional terminal.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
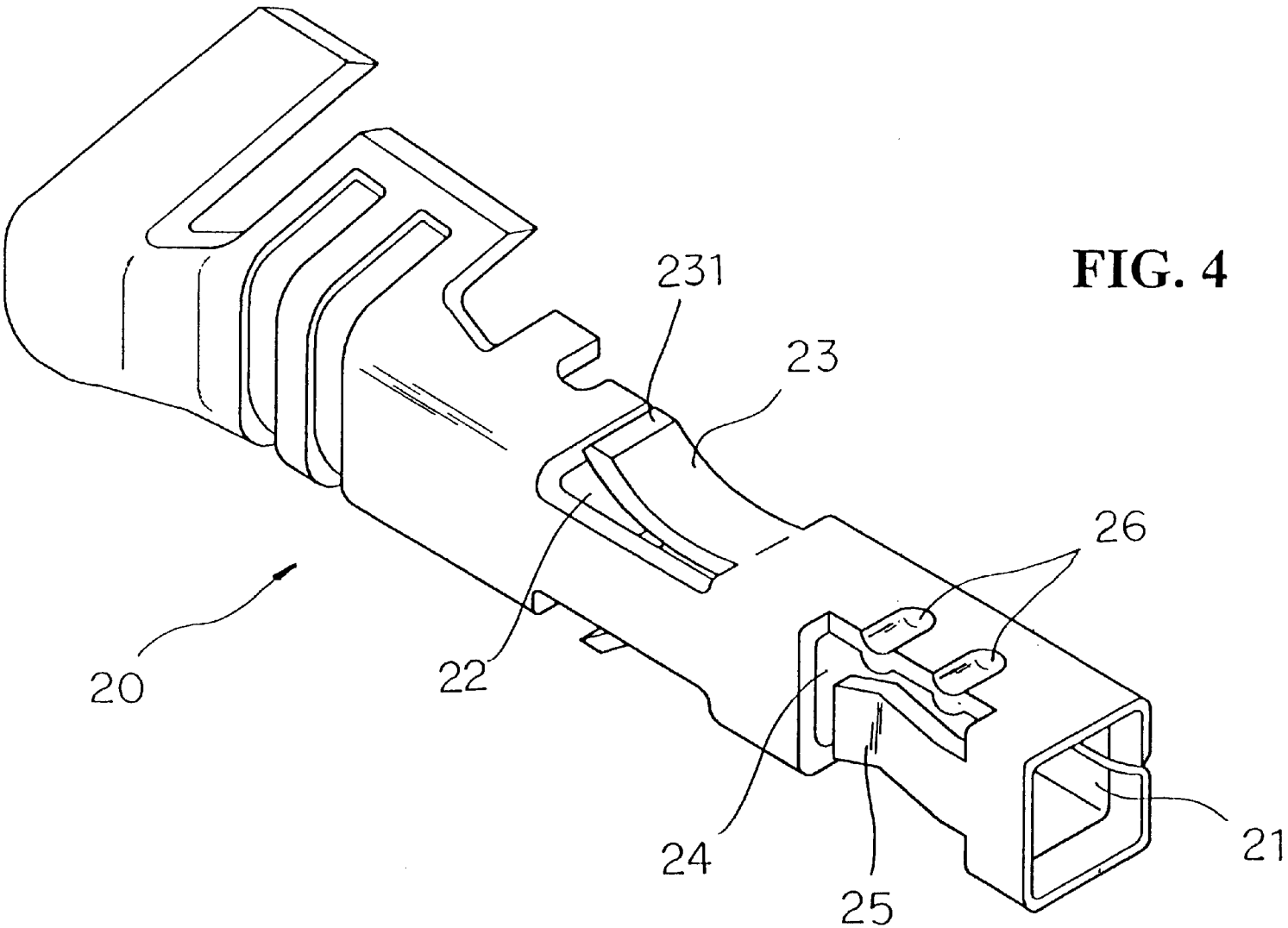
FIG. 4 is a schematic perspective view of a terminal of the present invention.
Figure 5:
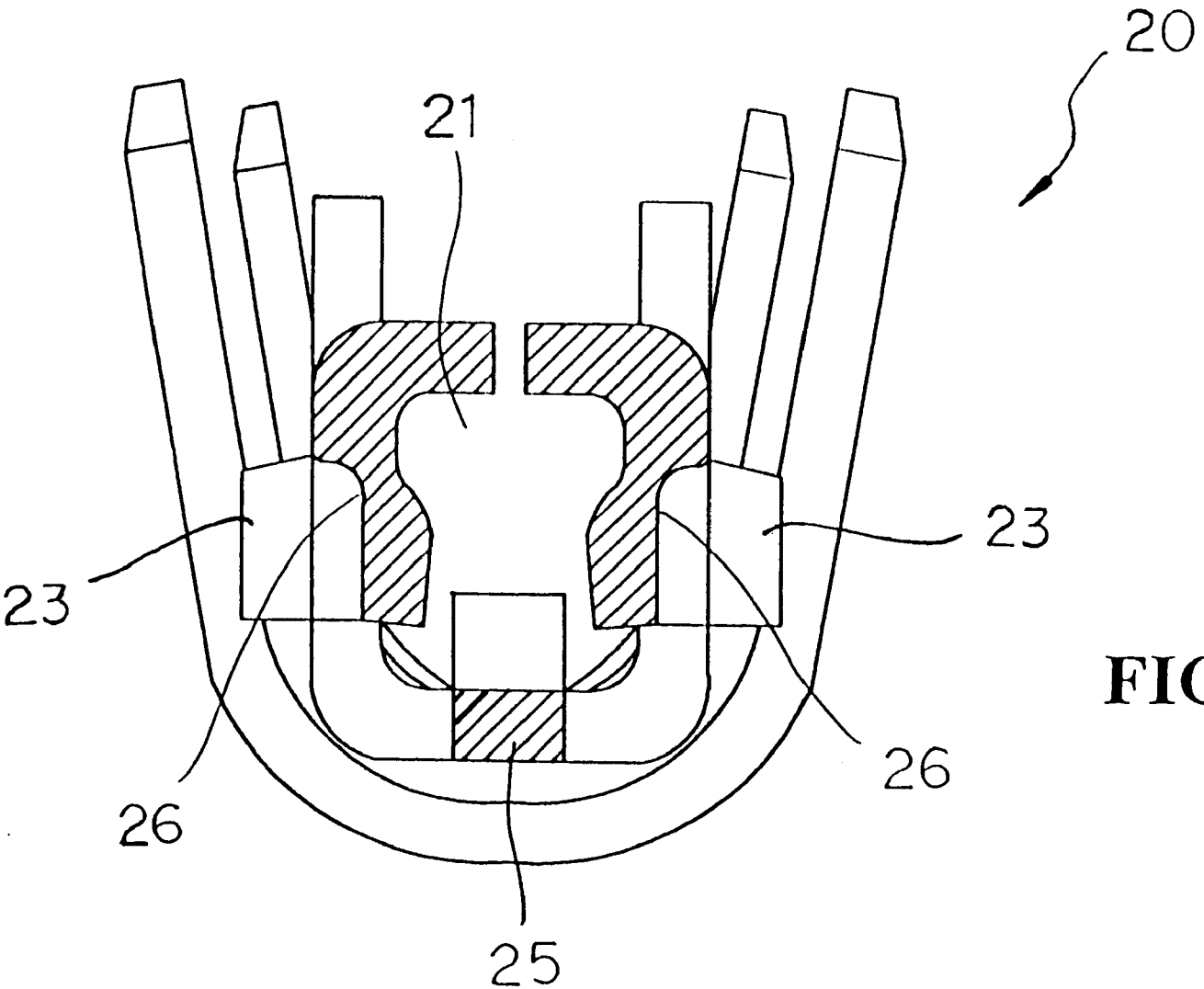
FIG. 5 is a schematic cross-sectional view of the terminal of the present invention.
Figure 6:
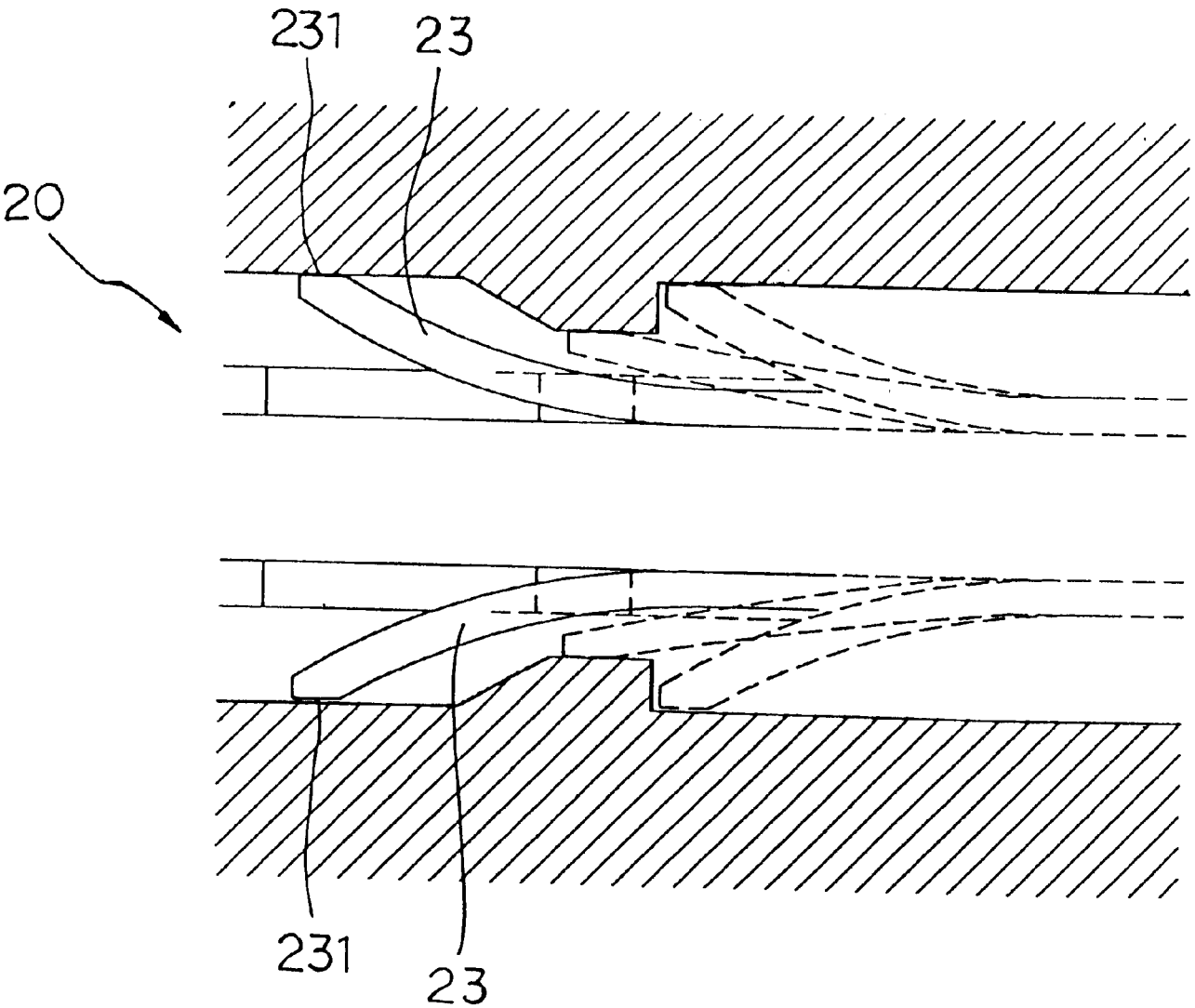
FIG. 6 is a schematic cross-sectional view of the terminal of the present invention in part.

With reference to FIGS. 4 and 5, a terminal 20 of the present intention is shown to include a through slot 21 adapted for passage of an electrical wire. Two through holes are respectively formed in both sides of an intermediate section of the terminal 20. The side of the through hole 22 oriented towards a front end of the terminal 20 is provided with an elastic curved urging plate 23. The terminal 20 is further provided with a slot 24 and an abutting plate 25 at a bottom side near the front end. Two depressed curved faces 26 are formed on both sides of the slot 24. As for the other structural elements of the terminal 20, as they are substantially the same as those of the conventional terminal, a detailed discussed thereon is dispensed with herein.

Figure 7:
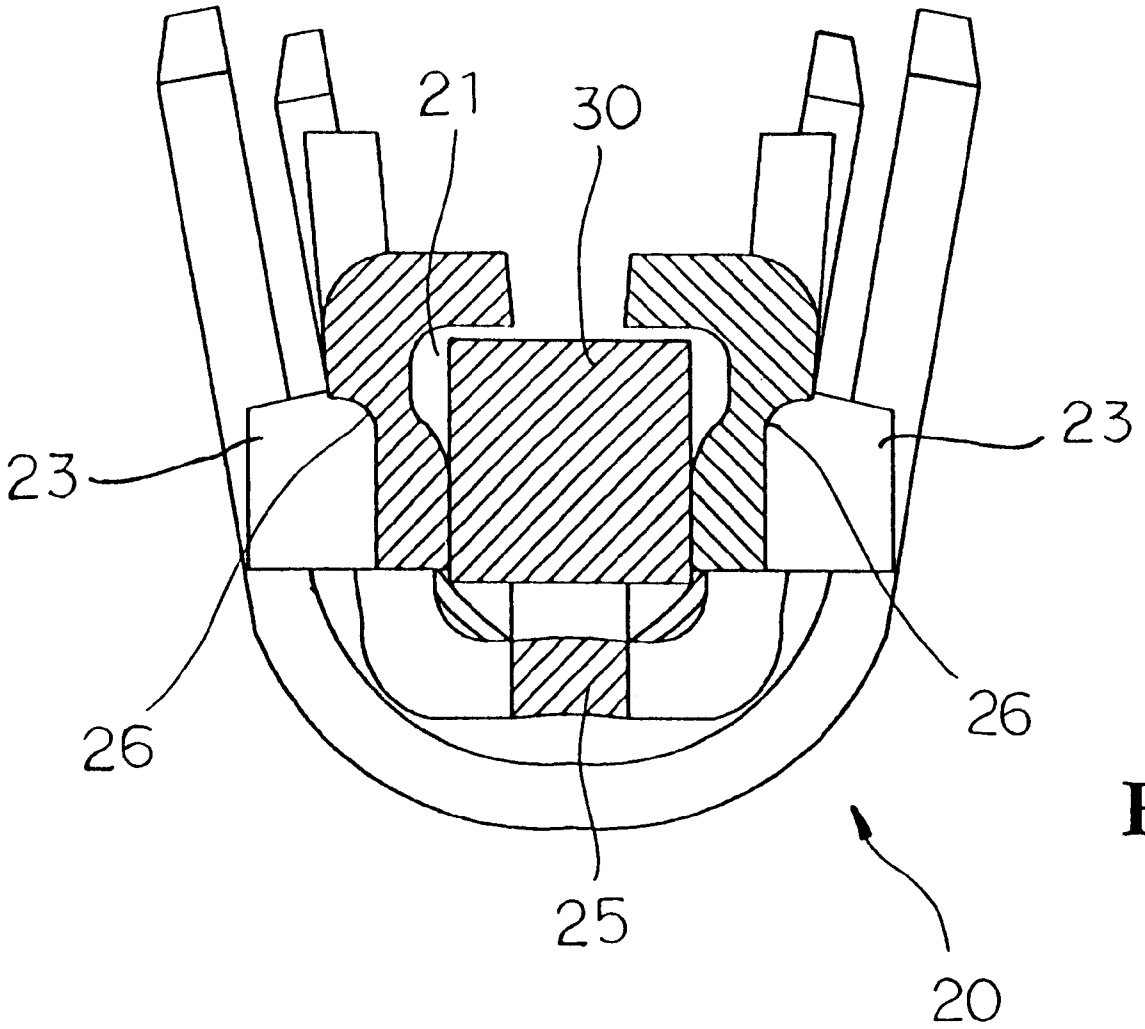
FIG. 7 is a schematic sectional view of the terminal of the present invention.

The present invention is mainly characterized in that: 1. The urging plates 23 are curved and have rear ends forming an abutting plane 231 that is parallel to an inner wall of a terminal interface slot; 2. the urging plates 25 is depressed to a certain degree near end edges thereof; and 3. the depressed curved faces 26 on both sides of the slot 24 are shallower at the lower end and deeper at the upper end. By virtue of the above characteristics, when a core wire 30 is inserted into the through slot 21 of the terminal 20 and both side walls of the terminal 20 are pressed inwardly towards the center of the terminal 20, the terminal 20 and the core wire 30 can be firmly secured, and the abutting plate 25 and the curved faces 26 can be in a plane contact with the core wire 30, respectively, to accomplish conduction, as shown in FIG. 7. In actual insertion of the terminal 20 into an interface slot, by means of the abutting planes 231 at the rear ends of the urging plates 23, the terminal 20 can be positively retained in the interface slot and prevented from slippage.

It can be appreciated from the above that the present invention has the following advantages:

1. Due to the configuration of the elastic curved urging plates 23, when the terminal 20 is coupled to a terminal interface slot, it can enter the slot with ease. And besides the abutting planes 231 at the rear ends of the urging plates 23 can abut tightly against the inner walls of the interface slot after insertion to secure the terminal 20 in the interface slot, unlike the prior art in which a greater force has to be applied to insert the terminal into the interface slot due to the bending angles of the retaining portions, and the pointed ends of the retaining portions affect the retaining effects. In comparison, the present invention allows easier insertion of the terminal into the interface slot and prevents slippage of the terminal therefrom.
2. The abutting plate 25 is disposed substantially in the center of the slot 24 and is depressed to a certain degree. And besides, the curved faces 26 are disposed on both sides of the slot 24 and are shallow at the lower end and deeper at the upper end. When the core wire 30 is clamped in the through slot 21 of the terminal, due to the depression of the curved faces 26 and the upward tilting of the abutting plate 25 on the bottom side, both the abutting plate 25 and the curved faces 26 are in a plane contact with the core wire 30 to ensure better conduction as opposed to the prior art.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A terminal, comprising a through slot adapted for passage of an electrical wire, said terminal having one end adapted to secure a sheath and core wire of said electrical wire, wherein: said terminal is provided with through holes on two opposed sides walls thereof at an intermediate section, each of said through holes having an elastic curved urging plate extending from a side that is proximate to a front end of said terminal, said terminal further having a slot formed in a bottom side near the front end, an abutting plate extending into said slot, two opposed depressed curved faces being formed on both side walls of said slot, said urging plates each have a rear end forming an abutting plane, and said depressed curved faces are shallower at a lower end and deeper at an upper end.

* * * * *